US011225758B1

(12) United States Patent
Gehringer et al.

(10) Patent No.: US 11,225,758 B1
(45) Date of Patent: Jan. 18, 2022

(54) AUTOMATED RAILROAD TIE UNLOADING

(71) Applicant: Union Pacific Railroad Company, Omaha, NE (US)

(72) Inventors: Eric John Gehringer, Papillion, NE (US); Brian L. Davis, Saint Charles, MO (US)

(73) Assignee: Union Pacific Railroad Company, Omaha, NE (US)

( * ) Notice: Subject to any disclaimer, the term of this patent is extended or adjusted under 35 U.S.C. 154(b) by 371 days.

(21) Appl. No.: 16/452,932

(22) Filed: Jun. 26, 2019

(51) Int. Cl.

| | |
|---|---|
| ***E01B 29/06*** | (2006.01) |
| ***E01B 3/20*** | (2006.01) |
| ***E01B 3/44*** | (2006.01) |
| ***E01B 3/48*** | (2006.01) |
| ***E01B 29/10*** | (2006.01) |
| ***E01B 23/12*** | (2006.01) |
| ***E01B 29/04*** | (2006.01) |

(52) U.S. Cl.
CPC ..... *E01B 29/06* (2013.01); *E01B 3/20* (2013.01); *E01B 3/44* (2013.01); *E01B 3/48* (2013.01); *E01B 23/12* (2013.01); *E01B 29/04* (2013.01); *E01B 29/10* (2013.01); *E01B 2201/00* (2013.01)

(58) Field of Classification Search
CPC ..... E01B 29/05; E01B 29/06; E01B 29/10; E01B 29/32
USPC ..... 104/2, 5, 6
See application file for complete search history.

(56) References Cited

U.S. PATENT DOCUMENTS

| | | | | |
|---|---|---|---|---|
| 3,162,145 | A | 12/1964 | Franklin et al. | |
| 3,683,816 | A * | 8/1972 | Berg | E01B 29/06 104/6 |
| 3,752,332 | A * | 8/1973 | Theurer | B65D 19/12 206/600 |
| 5,067,412 | A | 11/1991 | Theurer et al. | |
| 6,089,162 | A | 7/2000 | Madison | |
| 2020/0385934 | A1* | 12/2020 | Salciccia | E01B 29/06 |
| 2021/0179150 | A1* | 6/2021 | Lintz | B61D 3/02 |

FOREIGN PATENT DOCUMENTS

| | | | | |
|---|---|---|---|---|
| DE | 102004039581 B4 * | 1/2007 | | E01B 29/06 |
| FR | 2535359 A * | 5/1984 | | E01B 29/06 |
| FR | 2728285 A1 * | 6/1996 | | E01B 29/06 |

* cited by examiner

*Primary Examiner* — Zachary L Kuhfuss
(74) *Attorney, Agent, or Firm* — Daniel J. Honz; Advent, LLP

(57) ABSTRACT

Systems and methods for automatically offloading railroad ties from a railroad car are described. A system embodiment includes, but is not limited to, a support platform including a support surface to support railroad ties in a vertical stack configuration; a support structure to hold the railroad ties stacked in the vertical stack configuration in a magazine during transit, the support structure defining a gap; a gate transitionable between a closed configuration and an open configuration, wherein the closed configuration blocks at least a portion of the gap, and wherein the open configuration permits passage of the railroad ties through the gap; and a lift structure including at least one member transitionable between a lowered configuration and a raised configuration, wherein the raised configuration positions the member above the support surface to raise an end of the railroad ties to offload the vertical stack.

20 Claims, 4 Drawing Sheets

AUTOMATED RAILROAD TIE UNLOADING

BACKGROUND

Railroad tracks provide a foundation upon which rail cars, engines, and other equipment travel. Tracks generally include two parallel rails positioned on a perpendicular rail tie. Ties can be formed from wood, concrete, composite materials, or other materials to transfer load from the rails to a track base, ballast, and/or subgrade. Rails can be positioned on the ties via one or more tie plates secured to the ties (e.g., fixed in place via spikes through the tie plates). As railroad tracks require maintenance or are to be constructed, new ties can be positioned along the track or planned track for installation.

SUMMARY

Systems and methods for automatically offloading railroad ties from a railroad car are described. In an aspect, a system includes, but is not limited to, a support platform configured to be coupled to a railroad car, the support platform including a support surface configured to receive at least one railroad tie; a support structure positioned about the support platform defining a railroad tie magazine to hold the at least one railroad tie in a vertical stack configuration, the support structure defining a gap having a width that is greater than a width of the at least one railroad tie through which the at least one railroad tie is able to pass to offload the at least one railroad tie from the railroad car; a gate coupled to at least one side of the support structure, the gate transitionable between a closed configuration and an open configuration, wherein the closed configuration blocks at least a portion of the gap of the support structure to prevent passage of the at least one railroad tie through the gap, and wherein the open configuration permits passage of the at least one railroad tie through the gap of the support structure; and a lift structure coupled to the support platform, the lift structure including at least one member transitionable between a lowered configuration and a raised configuration, wherein the lowered configuration positions the member at or beneath the support surface, and wherein the raised configuration positions the member above the support surface to raise an end of the at least one railroad tie and shift a center of gravity of the at least one railroad tie beyond a midpoint of the support platform to offload the at least one railroad tie from the railroad car in the vertical stack configuration.

In an aspect, a system includes, but is not limited to, a plurality of railroad cars, wherein each railroad car of the plurality of railroad cars includes a support platform coupled to the railroad car, the support platform including a support surface configured to receive at least one railroad tie; a support structure positioned about the support platform defining a railroad tie magazine to hold the at least one railroad tie in a vertical stack configuration, the support structure defining a gap having a width that is greater than a width of at least one railroad tie through which the at least one railroad tie is able to pass to offload the at least one railroad tie from the railroad car; a gate coupled to at least one side of the support structure, the gate transitionable between a closed configuration and an open configuration, wherein the closed configuration blocks at least a portion of the gap of the support structure to prevent passage of the at least one railroad tie through the gap, and wherein the open configuration permits passage of the at least one railroad tie through the gap of the support structure; and a lift structure coupled to the support platform, the lift structure including at least one member transitionable between a lowered configuration and a raised configuration, wherein the lowered configuration positions the member at or beneath the support surface, and wherein the raised configuration positions the member above the support surface to raise an end of the at least one railroad tie and shift a center of gravity of the at least one railroad tie beyond a midpoint of the support platform to offload the at least one railroad tie from the railroad car in the vertical stack configuration.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. In the figures, the use of the same reference numbers in different instances in the description and the figures may indicate similar or identical items.

DETAILED DESCRIPTION

Overview

Figure 1A:
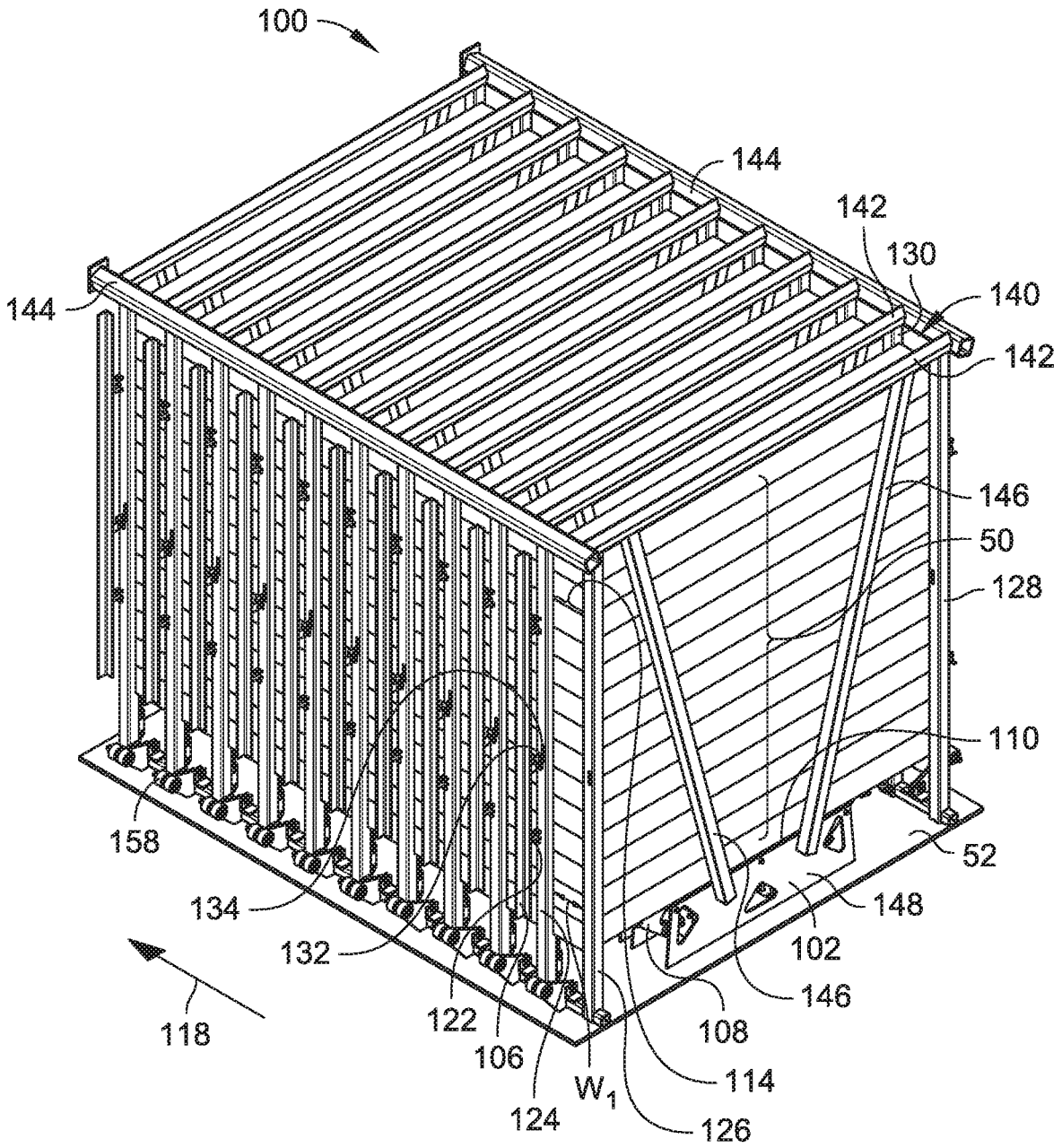
FIG. 1A is an isometric view of a system for automatically offloading railroad ties from a railroad car, with a plurality of railroad tie magazines shown holding vertical stack configurations of railroad ties, in accordance with example implementations of the present disclosure.
Figure 1B:
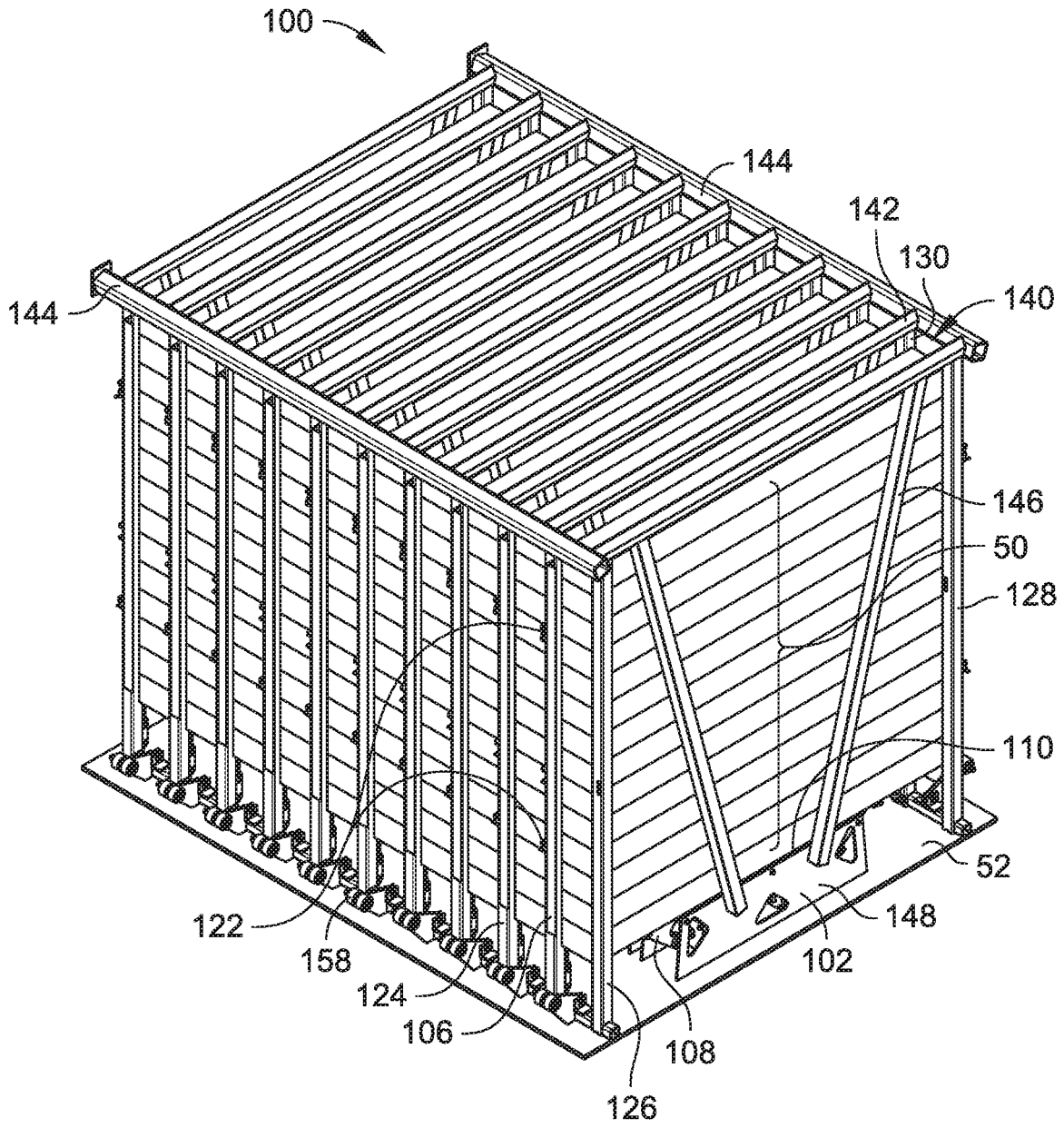
FIG. 1B is an isometric view of the system of FIG. 1A, with a gate in a closed position to hold the railroad ties in the vertical stack configurations within the plurality of railroad tie magazines.

During railroad track maintenance, installed railroad ties can be replaced with new or refurbished railroad ties. Replacement can involve positioning a new railroad tie adjacent the track, uncoupling an existing tie from any tie plates holding the tie to the rails, sliding the existing tie out from under the rails, inserting the new tie under the rails, introducing ballast around the new tie, installing new or existing tie plates, and securing the rail to the tie plates. Maintenance of railroad ties can be required due to normal wear and tear through usage, weather, or other activities, due to regular maintenance schedules, due to unforeseen activities, or for other reasons. Transporting new ties to locations where the new ties are to be unloaded and installed can require many resources. For instance, manual operators using unloading equipment can remove ties from railroad cars with winches, cranes, or other railroad freight-handling equipment, which requires significant time and manpower resources. Additionally, equipment on the railroad track utilizes track resources, where rail shipments may be diverted or delayed due to the presence of the tie-unloading equipment or personnel on the track.

Accordingly, the present disclosure is directed, at least in part, to systems and methods for automatically offloading railroad ties from a railroad car. Multiple railroad ties are stacked upon each other in a vertical stack configuration and held in a magazine defined by a support structure mounted to a railroad car. An example system employs a plurality of railroad tie magazines on a single railroad car to separate a plurality of vertical stacks of railroad ties on the railroad car. Each magazine can maintain the vertical stack configuration of the plurality of railroad ties held within the magazine during transit of the railroad car and while the ties are offloaded. The support structure includes a gate for each magazine that limits the lateral movement of the vertical stack of ties held within the magazine when the gate is closed and permits movement of the vertical stack of ties through the support structure when the gate is opened. Timing of the gates can be controlled to individually select which vertical stack of ties held in a particular magazine is to be offloaded from the railroad car. Each vertical stack of ties is supported by a support platform secured to the deck of the railroad car. The vertical stack of ties can be moved off the support platform and permitted to pass through the gate (in an open configuration) to empty the magazine. An example system includes a lift structure to raise an end of the vertical stack of railroad ties to shift a center of gravity of the vertical stack beyond a midpoint of the support structure and carry the railroad ties from the magazine off the railroad car through the gate.

In the following discussion, example implementations of systems and techniques for automatically offloading railroad ties from a railroad car are presented. The example embodiments may be combined, other embodiments may be utilized, or structural, logical, and electrical changes may be made, without departing from the scope of the claimed subject matter. The detailed description is, therefore, not to be taken in a limiting sense, and the scope is defined by the appended claims and their equivalents.

EXAMPLE IMPLEMENTATIONS

Referring generally to FIGS. 1A through 3, a system 100 for automatically offloading railroad ties from a railroad car is shown. The system 100 includes a support platform 102, a support structure 104, a gate 106, and a lift structure 108 to support and/or manipulate a plurality of railroad ties 50 held in a vertical stack configuration. A system 100 can include multiple sets of the support platform 102, the support structure 104, the gate 106, and the lift structure 108 to form multiple magazines configured to facilitate handling of multiple vertical stacks of railroad ties, as shown in FIGS. 1A and 1B. Ten vertical stacks of railroad ties having fourteen railroad ties in each vertical stack are shown, however the system 100 is not limited to such arrangement of ties. For instance, the system 100 can include fewer than ten magazines (e.g., one, two, three, four, five, six, seven, eight, nine magazines) to facilitate fewer than ten vertical stacks of railroad ties or the system can include more than ten magazines (e.g., eleven, twelve, thirteen, fourteen, fifteen, twenty, twenty five, thirty, etc. magazines) to facilitate more than ten vertical stacks of railroad ties. The support platform 102 is configured to be coupled to a railroad car, such as a deck 52 of the railroad car. For example, the deck 52 can be a portion of a gondola type railroad car, a flat railroad car, or other configuration of railroad car utilizes to support the system 100 during transit to move and offload the plurality of railroad ties 50. The system 100 can also be introduced to one or more railroad cars, such that each railroad car supports one or more magazines holding the vertical stacks of railroad ties. For example, when hundreds or thousands of railroad ties are desired for a particular location or a particular geographic region, the system 100 can be introduced to multiple railroad cars to facilitate transport of hundreds or thousands of railroad ties automatically with significantly fewer resources utilized (e.g., time resources, manpower resources, track resources, etc.) as compared to manual offloading of traditional railroad tie delivery systems.

The support platform 102 includes a support surface 110 configured to receive the plurality of railroad ties 50 stacked in the vertical stack configuration. For instance, the support platform 102 holds the plurality of railroad ties 50 on the support surface 110 during transit of the railroad car, where friction between the bottom railroad tie and the support surface 110 facilitates maintaining the plurality of railroad ties 50 on the support platform 102. In an embodiment, the support surface 110 is positioned above the deck 52 of the railroad car to provide a space between the support surface and the deck 52 to house the lift structure 108. The support surface 110 can have a length (shown as $L_1$ in FIG. 2) that is less than a length of a railroad tie 50 (shown as $L_2$ in FIG. 2) to be handled by the system 100, such that a portion of a bottom side of the bottom railroad tie 50 of the vertical stack interfaces with the support surface 110 and a portion of the bottom side of the bottom railroad tie 50 of the vertical stack does not interface with the support surface 110. For instance, the bottom railroad tie 50 can have a first end 112A and a second end 112B that hang over the support surface 110 with the portion of the railroad tie 50 between the first end 112A and the second end 112B positioned on the support surface 110. In embodiments, the support surface 110 is configured to be substantially parallel to the deck 52 of the railroad car to maintain the plurality of railroad ties 50 in a generally parallel arrangement with respect to the deck 52. Alternatively or additionally, one or more support surfaces 110 of the system 100 can be displaced at an angle relative to the deck 52 of the railroad car to maintain the plurality of railroad ties at an angle with respect to the deck 52 (e.g., a non-parallel arrangement relative to the deck 52).

The support structure 104 of the system 100 forms a magazine structure to maintain the plurality of railroad ties 50 in the vertical stack configuration. When the system 100 includes multiple magazines, the support structure 104 maintains separation of one or more vertical stacks of railroad ties 50 from other vertical stacks of railroad ties 50. While the system 100 is described herein as handling one or more pluralities of railroad ties 50, it is to be understood that the system 100 is not limited to magazines configured to hold one or more pluralities of railroad ties 50, and can includes magazines holding a single railroad tie 50 or zero railroad ties 50 (e.g., an unloaded magazine, a magazine having previously unloaded one or more railroad ties, etc.). Additionally, the system 100 can include one or more magazines defined by the support structure 104 that hold multiple vertical stacks of railroad ties 50 within a single magazine. For example, each vertical stack can be positioned on the same support surface 110 for offloading at the same time. In an embodiment, the system 100 includes multiple support structures defining multiple railroad tie magazines to separate singular vertical stacks of railroad ties 50 from other singular vertical stacks of railroad ties 50. The support structure 104 is positioned about the support platform 102, with the support surface 110 enclosed within a volume defined by the support structure 104 to provide the magazine about the plurality of railroad ties 50 held on the support surface 110 in the vertical stack configuration. In embodiments, components of the system 100 are generally formed from durable materials utilized to support and handle loads of multiple railroad ties, including but not limited to, steel, steel alloys, iron, iron alloys, composite materials, or the like, and combinations thereof.

The support structure 104 defines a gap 114 to permit passage of the plurality of railroad ties 50 out from the support structure 104 through the gap 114. The gap 114 can be positioned on a side 116 of the support structure 104, such that a plurality of magazines positions multiple gaps 114 along the side of the railroad car in the longitudinal direction. For example, the gap 114 has a width (shown as Wi in FIG. 1A) that is greater than a width of a railroad tie 50 to be received by the support structure such that, when the gap 114 is exposed or otherwise open, the railroad tie or plurality of railroad ties 50 is able to pass through the gap 114 and discharged from the railroad car in a direction substantially counter (e.g., a non-parallel direction) to the direction of travel of the railroad car (shown as 118 in FIG. 1A). The support structure 104 can define another gap 114 on a side 120 of the support structure 104 opposite the side 116 to provide gaps 114 on opposing sides of the railroad car to offload railroad ties 50 on either side of the railroad car, described further herein.

The system 100 includes the gate 106 to control access of the gap 114 to railroad ties 50 held within the magazine defined by the support structure 104. For example, the gate 106 can be coupled to the side 116 of the support structure 104 to interact with the gap 114 to prevent or allow access based on the positioning of the gate 106. In embodiments, the gate 106 transitions between a closed configuration (e.g., shown in FIGS. 1B and 2) and an open configuration (e.g., shown in FIGS. 1A and 3). The closed configuration blocks at least a portion of the gap 114 to prevent passage of the plurality of railroad ties 50 through the gap 114. The open configuration permits passage of the plurality of railroad ties 50 through the gap 114. In embodiments, the gate 106 is rotatably coupled to the support structure 104 by one or more gate hinges 122, where the gate 106 can rotate about the gate hinges 122 to transition between the closed configuration and the open configuration. For example, the support structure 104 can include a first upward-extending member 124 and a second upward-extending member 126 positioned at the first end 116. In implementations, the gap 114 is defined by spacing between the first upward-extending member 124 and the second upward-extending member 126. As shown in FIG. 1A, the gate hinges 122 are coupled between the first upward-extending member 124 and the gate 106, where the gate 106 extends from the first upward-extending member 124 and rotates towards the second upward-extending member 126 when transitioned from the open configuration to the closed configuration. Similarly, the support structure 104 can define the gap 114 on side 120 through spacing between a third upward-extending member 128 and a fourth upward-extending member 130 positioned at the side 120, with another gate 106 coupled via one or more gate hinges 122 to one of the third upward-extending member 128 or the fourth upward-extending member 130 (shown in FIG. 2 as coupled to the third upward-extending member 128). The gate 106 on side 120 can operate similarly to the gate 106 on side 116, such as to transition between an open configuration and a closed configuration through rotation about the one or more gate hinges 122 to control access to the gap 114 on side 120 to railroad ties 50 held within the magazine defined by the support structure 104. The upward-extending members (e.g., 124, 126, 128, 130) are shown extending upwards at substantially perpendicular with respect to the deck 52, however the system 100 is not limited to such configuration and can include one or more upward-extending members extending upwards from the deck 52 at a non-normal angle.

Figure 2:
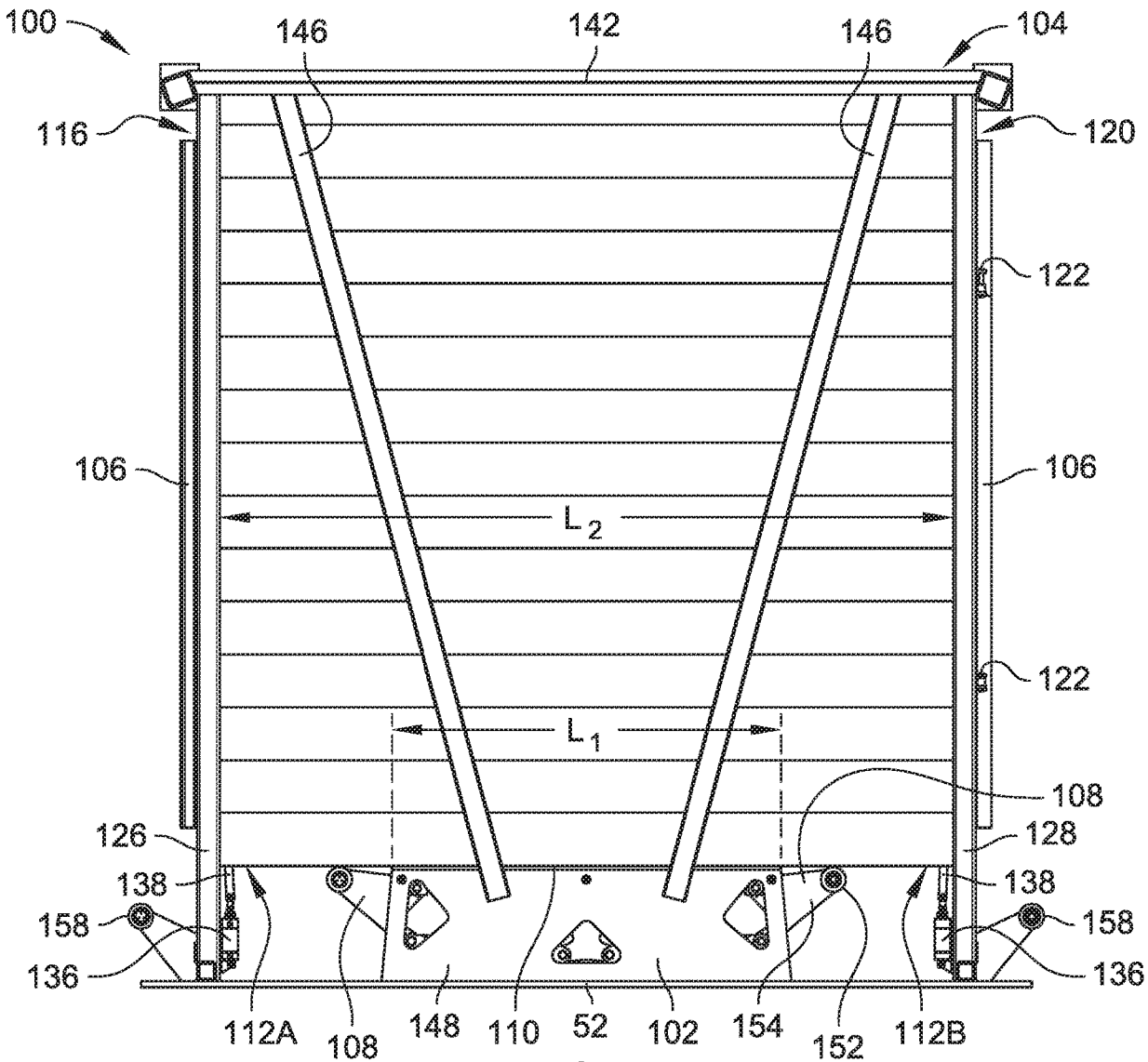
FIG. 2 is an end view of the system of FIG. 1A in a loaded configuration within a railroad tie magazine.

The system 100 can include one or more mechanisms to control actuation of the gate 106 to transition the gate between the open configuration and the closed configuration. For example, the system 100 can include a latch 132 configured to couple with at least a portion of gate 106 to fix the gate 106 in position with respect to the gap 114. The latch 132 can transition between a locked configuration and an unlocked configuration through sliding within a slot 134 formed in one of the upward-extending members of the support structure (such as the first upward-extending member 124 shown in FIG. 1A), where the locked configuration holds the gate 106 closed relative to the gap 114, and where the unlocked configuration permits the gate 106 to rotate or otherwise open. The system 100 can include a spring or other biasing member as part of or in addition to the gate hinge 122 to bias the gate 106 in the open or closed configuration to facilitate coordination with the latch 132. The latch 132 can be actuated through a pneumatic actuator to transition the latch between the open configuration and the closed configuration. For example, the system 100 can include a pneumatic cylinder 136 coupled to the support structure 104 or to the deck 52 of the railroad car. The pneumatic cylinder 136 is shown in FIG. 2 coupled to the support structure 104 to fix the body of the pneumatic cylinder 136 in place relative to the support structure 104. The pneumatic cylinder 136 includes a rod 138 that extends upward from the pneumatic cylinder 136 to engage with the latch 132. For instance, the rod 138 can be coupled to the latch 132 through the slot 134 to move the latch 132 upwards and downwards upon being extended by the pneumatic cylinder 136 or retracted within the pneumatic cylinder 136, respectively. When the pneumatic cylinder 136 extends the rod 138 upwards, the rod can move the latch 132 with respect to the gate 106 to permit the gate 106 to rotate out from the gap 114 to provide an opening through which the plurality of railroad ties 50 can pass. When the rod 138 is retracted, the latch 132 can interact with a portion of the gate 106 to prevent the gate 106 from rotating to block at least a portion of the gap 114. While a pneumatically-actuatable latch is described, it can be appreciated that other mechanisms used to lock and unlock the gate 106 can be utilized.

The plurality of railroad ties 50 can be loaded into the magazine defined by the support structure 104 according to one or more procedures. For example, the railroad ties 50 can be loaded, individually or as a group in the vertical stack configuration, from a side of the railroad car or from the top of the railroad car. For instance, the railroad ties 50 can be loaded from a side of the railroad car through one or more of the gaps 114 in the support structure 104 (e.g., through the gap 114 on the side 116 and/or through the gap 144 on the side 120, where the gates 106 on the respective sides are in an open configuration). Alternatively or additionally, the railroad ties 50 can be loaded through an opening 140 at the top of the support structure 104. For example, the support structure 104 can include cross supports 142, where cross supports 142 define the opening 140 between respective cross supports 142. The cross supports 142 can be supported by the upward-extending members (e.g., 124, 126, 128, 130), such as being suspended between two of the upward-extending members on opposing sides of the support structure 104, or supported by other support piece of the support structure 104. In implementations, ends of the cross supports 142 are coupled to opposing lateral support beams 144. The support structure 104 can further include one or more support members 146 to define a guide frame for railroad ties 50 within the magazine, which can assist in maintaining the railroad ties 50 within the vertical stack configuration when in the magazine. For example, the support structure 104 can include support members 146 extending from a face plate 148 of the support platform 102 to the cross supports 142 to define the magazine. Alternatively or additionally, the support members 146 can be coupled to the deck 52 of the railroad car. The support members 146 are shown extending upwards from the face plate 148 at a non-normal angle with respect to the deck 52, however the system 100 is not limited to such configuration and can include one or more support members 146 extending vertically upwards from the face plate 148 perpendicular with respect to the deck 52.

Figure 3:
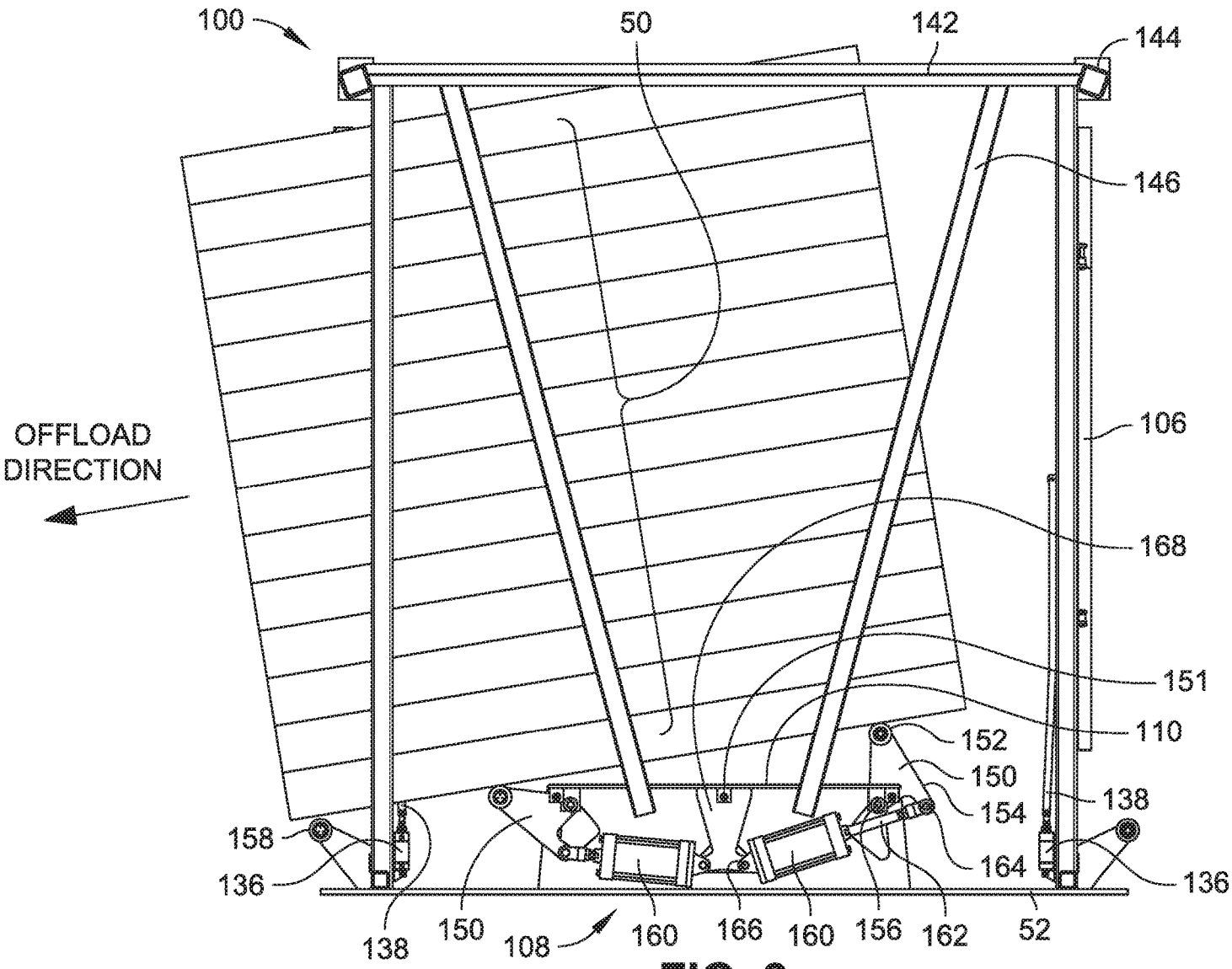
FIG. 3 is a partial end view of the system of FIG. 1A with a lift structure in a raised configuration to offload a plurality of railroad ties in a vertical stack configuration from a magazine.

The lift structure 108 facilitates offloading the railroad ties 50 from the system 100 through manipulating the positioning of the railroad ties 50 within the support structure 104. For example, the lift structure 108 can include a lift member 150 that transitions between a lowered configuration and a raised configuration to offload the railroad ties 50 from the railroad car. In the lowered configuration (e.g., shown in FIGS. 1A, 1B, and 2), the lift structure 108 positions the lift member 150 at or beneath the support surface 110. In the raised configuration (e.g., as shown in FIG. 3, the right lift member 150), the lift structure 108 positions the lift member 150 above the support surface 110 to raise an end of the plurality of railroad ties (e.g., the second end 112B). For instance, raising the end of the plurality of railroad ties can shift a center of gravity of the vertical stack beyond a midpoint 151 of the support platform 102 to offload the plurality of railroad ties 50 from the railroad car in the vertical stack configuration. The lift member 150 can include a roller 152 positioned at an end 154 of the lift member 150 distal from a rotational coupling 156 of the lift member to the support platform 102. The roller 152 interfaces with the bottom side of the bottom railroad tie 50 of the vertical stack when the lift member 150 is in the raised configuration to lift the railroad tie and corresponding stack off the support surface 110. The roller 152 can also interface with the bottom side of the bottom railroad tie 50 of the vertical stack when the lift member 150 is in the lowered configuration. Alternatively, when the lift member 150 is in the lowered configuration, the roller 152 is positioned beneath the support surface 110, such that the support surface 110 supports the entirety of the vertical stack of railroad ties 50. The system 100 can also include a second roller 158 positioned adjacent the side of the support structure 104 (e.g., adjacent the gap 114 at the first side 116 and/or the second side 120) to interface with the plurality of railroad ties 50 as the vertical stack passes through the gap 114 during offload. For example, as shown in FIG. 3, as the vertical stack of railroad ties 50 is lifted by the lift member 150 in the raised configuration, the vertical stack travels towards the side 116 of the support structure 104 and through the gap, where the vertical stack is supported by the roller 152 of the left lift member 150 (in the lowered configuration) and the roller 158 adjacent the gap 114 at the side 116. Following offload of the plurality of railroad ties 50 from the system, the railroad ties are dropped from the railroad car adjacent the railroad track. While aspects of the system 100 are described as including rollers (e.g., 152, 158), the system 100 alternatively or additionally can include static structures (e.g., low friction structures) configured to interact with the bottom surface of the vertical stack of railroad ties 50 during offload procedures.

The lift structure 108 can be pneumatically actuatable to transition the lift member 150 between the lowered configuration and the raised configuration. For example, as shown in FIG. 3, the lift structure 108 can include one or more pneumatic cylinders (two cylinders 160 are shown) having a rod 162 displaced (e.g., linearly displaced) from the cylinder 160 during actuation of the cylinder 160 (e.g., introduction of pressure within the cylinder 160). The lift member 150 can be coupled to the rod 162 via a rotational coupling 164 to permit rotation of the lift member 150 relative to the rod 162 during transition between the lowered configuration and the raised configuration. As the cylinder 160 pushes the rod 162 outwards from the cylinder 160, the lift member 150 rotates about rotational coupling 156 to push the roller 152 against the vertical stack of railroad ties 50 during transition between the lowered configuration and the raised configuration. The fluid introduced into the cylinder (e.g., air, hydraulic fluid, etc.) to displace the rod 162 can be introduced via an external control system in an amount sufficient to overcome the weight of the railroad ties 50 to lift the stack to an exit angle for offload from the railroad car. In an example, the force to offload a 14-tie stack can be from about 2700 lbs to about 4100 lbs, where the force can vary depending on actual tie weights and sizes, cross elevation, frictional forces, and the like. Each cylinder 160 can be fixed relative to the support platform 102, for example, via one or more mounts 166 coupled to a flange 168 of the support platform 102). Cylinders 160 housed in a particular support platform 102 (e.g., beneath a particular support surface 110) can be independently controllable such that one cylinder 160 can be utilized to transition one lift member 150 to the raised configuration while the other cylinder 160 maintains the other lift member 150 in the lowered configuration.

The system 100 can include multiple lift structures 108 to facilitate offloading of multiple stacks of railroad ties 50. For instance, each magazine defined by the support structure 104 can include a pair of cylinders 160 to engage with a respective pair of lift members 150. Activation of one lift member 150 of the pair by the respective cylinder 160 lifts the vertical stack of railroad ties 50 for offload from the railroad car on the side opposite the lift member 150 that was activated. The system 100 can include a control system that can independently activate one or more cylinders 160 of the system 100 to select which cylinder 160 of a selected lift structure 108 is to be activated to offload a specific vertical stack of railroad ties 50 from a specific magazine from a specific side of the railroad car. For example, the control system can select the right cylinder 160 in FIG. 3 to offload the vertical stack of railroad ties 50 from the left side of the railroad car, whereas a different cylinder 160 in a separate magazine can be actuated by the control system to offload the other vertical stack of railroad ties 50 in the separate magazine from the left side or the right side of the railroad car.

The control system can also coordinate actuation of the gate 106 with actuation of the lift mechanism 108 such that the gate 106 permits access to the gap 114 for the vertical stack of railroad ties 50 during offload. For example, the control system can coordinate actuation of the gate 106 from the closed configuration to the open configuration with actuation of the lift structure 108 from the lowered configuration to the raised configuration. For instance, the control system can control actuation of the pneumatic cylinder 136 (e.g., to open the gate 106) with actuation of the cylinder 160 (e.g., to raise the lift member 150). In embodiments, the control system actuates the pneumatic cylinder 136 prior to actuation of the cylinder 160. In embodiments, the control system actuates the pneumatic cylinder 136 contemporaneously with actuation of the cylinder 160. In embodiments, the control system actuates the pneumatic cylinder 136 after actuation of the cylinder 160.

The control system can control various portions of the system 100 through manual input by a user (e.g., via a user interface), through automated preprogrammed protocols, or combinations thereof. For example, the control system can actuate one or more portions of the system 100 according to a position of the railcar, such as through GPS coordinates (or other positioning or geolocating system) of the railcar. For instance, when the railcar approaches or arrives at a given GPS location, the control system can actuate one or more gates 106 and corresponding lift mechanism(s) to offload one or more vertical stacks of railroad ties 50 held within respective magazines. The offload procedure can be accomplished with the railcar in motion, stationary, or combinations thereof.

The system 100 can include, alternatively or additionally, support platforms 102 having different offload mechanisms. For example, the support platform 102 can include the support surface 110 displaced at an angle relative to the deck 52 of the railroad car to maintain the plurality of railroad ties at an angle with respect to the deck 52 (e.g., a non-parallel arrangement relative to the deck 52). To offload the railroad ties 50 in this instance, the gate can be opened to permit the railroad ties 50 to slide out from the magazine of the support structure 104 without a lift mechanism 108 used to lift an end of the railroad ties 50. Alternatively or additionally, the system 100 can include a pushing device to push the railroad ties 50 off the support surface 110 when the gate 106 is in the open configuration. For example, the pushing device can interact with an end of the railroad ties 50 to laterally push the ties towards the opposite end of the railroad car and offload the railroad ties 50 through the gap 114.

Example Railroad Tie Offload Procedure

Automated delivery of bulk railroad ties facilitated by the system 100 is provided below in a non-limiting example.

A geographic region is in need of 1,100 railroad ties for scheduled maintenance of railroad track affected by regional flooding. Multiple railroad cars are fitted with the system 100 to transport about 79 vertical stacks of railroad ties, with about 14 railroad ties stacked vertically within each magazine defined by the support structure 104. At a loading station, railroad ties are introduced, singly or in vertical stacks, to each magazine through the openings 140 at the top of the support structure 104, through the gaps 114 at the sides of the support structure 104, or combinations thereof. An engine transports the railroad cars from the loading station to the geographic region in need of the railroad ties. The railroad ties are held within the magazines in the vertical stack configuration on the support surface 110 during transit. The control system accesses a number of GPS coordinates to engage the gates 106 and the lift mechanisms 108 to offload vertical stacks of the railroad ties as the railroad cars are in motion. Each railroad car can adopt a unique offload procedure, where, for example, one railroad car offloads all vertical stacks of railroad ties on one side of the railroad car (e.g., each system 100 on that railroad car engages the pneumatic 136 and cylinder 160 on the same side), whereas another railroad car offloads all vertical stacks of railroad ties on the opposite side of the railroad car. The control system can also facilitate offloading vertical stacks of railroad ties from different sides of the same railroad car. The direction of discharge of the vertical stacks of railroad ties are controlled based on geographical features, structures, railroad track configurations, or the like present at the GPS coordinates accessible by the control system. For example, for a particular location, a ravine is present on one side of the railroad track, so the system 100 coordinates a directionality component to the GPS coordinate to offload in the direction on the opposite side of the railroad car to avoid offloading the railroad ties into the ravine. In another location, another railroad track is present on the opposite side of the railroad track as the ravine, so the system 100 includes a directionality component to offload in the direction on the opposite side of the railroad car to avoid offloading the railroad ties onto the other railroad track at that particular geographical location. Alternatively or additionally, an operator (e.g., an operator location on the train) can manually control operation of the gates 106 and/or the lifting mechanisms 108 through an interface communicatively coupled with the pneumatic actuators of the gates 106 and/or the lifting mechanisms 108 offload the vertical stacks of railroad ties from specific magazines on demand. For example, a particular location still has flood damage, so the operator overrides a discharge command and opts for manual offload further down the railroad track where flood waters have receded.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

The invention claimed is:

1. An automated railroad tie unloading system, comprising:

a support platform configured to be coupled to a railroad car, the support platform including a support surface configured to receive at least one railroad tie;

a support structure positioned about the support platform defining a railroad tie magazine to hold the at least one railroad tie in a vertical stack configuration, the support structure defining a gap having a width that is greater than a width of the at least one railroad tie through which the at least one railroad tie is able to pass to offload the at least one railroad tie from the railroad car;

a gate coupled to at least one side of the support structure, the gate transitionable between a closed configuration and an open configuration, wherein the closed configuration blocks at least a portion of the gap of the support structure to prevent passage of the at least one railroad tie through the gap, and wherein the open configuration permits passage of the at least one railroad tie through the gap of the support structure; and a lift structure coupled to the support platform, the lift structure including at least one member transitionable between a lowered configuration and a raised configuration, wherein the lowered configuration positions the member at or beneath the support surface, and wherein the raised configuration positions the member above the support surface to raise an end of the at least one railroad tie and shift a center of gravity of the at least one railroad tie beyond a midpoint of the support platform to offload the at least one railroad tie from the railroad car in the vertical stack configuration.

2. The automated railroad tie unloading system of claim 1, wherein the lift structure includes a pneumatic cylinder configured to move a rod upon actuation, the rod coupled to the member to transition the member between the lowered configuration and the raised configuration.

3. The automated railroad tie unloading system of claim 2, wherein the member is rotatably coupled to each of the support platform and the rod to rotate from the lowered configuration to the raised configuration upon actuation of the pneumatic cylinder.

4. The automated railroad tie unloading system of claim 1, further comprising a roller coupled to an end of the member of the lift structure, the roller configured to interface with the at least one railroad tie when the lift mechanism is in the raised configuration.

5. The automated railroad tie unloading system of claim 4, wherein the roller is configured to interface with the at least one railroad tie when the lift mechanism is in each of the raised configuration and the lowered configuration.

6. The automated railroad tie unloading system of claim 4, further comprising a second roller positioned adjacent the gap defined by the support structure, the second roller configured to interface with the at least one railroad tie as the at least one railroad tie passes through the gap during offload from the railroad car.

7. The automated railroad tie unloading system of claim 1, wherein the support structure includes a first upward-extending member and a second upward-extending member, wherein a distance between the first upward-extending member and the second upward-extending member defines the gap, and wherein the gate is coupled to at least one of the first upward-extending member and the second upward-extending member.

8. The automated railroad tie unloading system of claim 7, wherein the support structure further includes a third upward-extending member and a fourth upward-extending member, wherein the support platform is positioned between the first upward-extending member and the third upward-extending member and the support platform is positioned between the second upward-extending member and the fourth upward-extending member, and wherein a distance between the third upward-extending member and the fourth upward-extending member defines a second gap having a width that is greater than a width of a railroad tie of the plurality of railroad ties.

9. The automated railroad tie unloading system of claim 8, further comprising a second gate coupled to at least one of the third upward-extending member and the fourth upward-extending member, the second gate transitionable between a closed configuration and an open configuration, wherein the closed configuration of the second gate blocks at least a portion of the second gap to prevent passage of the at least one railroad tie through the second gap, and wherein the open configuration of the second gate permits passage of the at least one railroad tie through the second gap.

10. The automated railroad tie unloading system of claim 7, wherein the gate is coupled to one of the first upward-extending member or the second upward-extending member via a gate hinge, and wherein the gate is configured to rotate about the gate hinge to transition between the closed configuration and the open configuration.

11. The automated railroad tie unloading system of claim 1, further comprising a pneumatically-actuatable latch coupled to the gate, the pneumatically-actuatable latch configured to transition between a locked configuration and an unlocked configuration, wherein the locked configuration maintains the gate in the closed configuration and the unlocked configuration permits transition of the gate to the open configuration.

12. The automated railroad tie unloading system of claim 1, further comprising a controller configured to coordinate actuation of the gate from the closed configuration to the open configuration with actuation of the lift structure from the lowered configuration to the raised configuration.

13. An automated railroad tie unloading system, comprising:

a plurality of railroad cars, wherein each railroad car of the plurality of railroad cars includes a support platform coupled to the railroad car, the support platform including a support surface configured to receive at least one railroad tie;

a support structure positioned about the support platform defining a railroad tie magazine to hold the at least one railroad tie in a vertical stack configuration, the support structure defining a gap having a width that is greater than a width of the at least one railroad tie through which the at least one railroad tie is able to pass to offload the at least one railroad tie from the railroad car;

a gate coupled to at least one side of the support structure, the gate transitionable between a closed configuration and an open configuration, wherein the closed configuration blocks at least a portion of the gap of the support structure to prevent passage of the at least one railroad tie through the gap, and wherein the open configuration permits passage of the at least one railroad tie through the gap of the support structure; and a lift structure coupled to the support platform, the lift structure including at least one member transitionable between a lowered configuration and a raised configuration, wherein the lowered configuration positions the member at or beneath the support surface, and wherein the raised configuration positions the member above the support surface to raise an end of the at least one railroad tie and shift a center of gravity of the at least one railroad tie beyond a midpoint of the support platform to offload the at least one railroad tie from the railroad car in the vertical stack configuration.

14. The automated railroad tie unloading system of claim 13, wherein each railroad car of the plurality of railroad cars further comprises:

a second support platform adjacent the support platform, the second support platform coupled to the railroad car, the second support platform including a second support surface configured to receive a second set of railroad ties;

a second support structure positioned about the second support platform defining a second railroad tie magazine to hold the second set of railroad ties in a vertical stack configuration, the second support structure defining a second gap between the second support structure and the support structure, the second gap having a width that is greater than a width of the second set of railroad ties through which the second set of railroad ties is able to pass to offload the second set of railroad ties from the railroad car;

a second gate coupled to at least one side of the second support structure, the second gate transitionable between a closed configuration and an open configuration, wherein the closed configuration blocks at least a portion of the second gap of the second support structure to prevent passage of the second set of railroad ties through the second gap, and wherein the open configuration permits passage of the second set of railroad ties through the second gap of the second support structure; and a second lift structure coupled to the second support platform, the second lift structure including at least one second member transitionable between a lowered configuration and a raised configuration, wherein the lowered configuration positions the second member at or beneath the second support surface, and wherein the raised configuration positions the second member above the second support surface to raise an end of the second set of railroad ties and shift a center of gravity of the second set of railroad ties beyond a midpoint of the second support platform to offload the second set of railroad ties from the railroad car in the vertical stack configuration.

15. The automated railroad tie unloading system of claim 13, wherein the lift structure includes a pneumatic cylinder configured to move a rod upon actuation, the rod coupled to the member to transition the member between the lowered configuration and the raised configuration.

16. The automated railroad tie unloading system of claim 15, wherein the member is rotatably coupled to each of the support platform and the rod to rotate from the lowered configuration to the raised configuration upon actuation of the pneumatic cylinder.

17. The automated railroad tie unloading system of claim 13, further comprising a roller coupled to an end of the member of the lift structure, the roller configured to interface with the at least one railroad tie when the lift mechanism is in the raised configuration.

18. The automated railroad tie unloading system of claim 17, further comprising a second roller positioned adjacent the gap defined by the support structure, the second roller configured to interface with the at least one railroad tie as the at least one railroad tie passes through the gap during offload from the railroad car.

19. The automated railroad tie unloading system of claim 13, wherein the support structure includes a first upward-extending member and a second upward-extending member, wherein a distance between the first upward-extending member and the second upward-extending member defines the gap, and wherein the gate is coupled to at least one of the first upward-extending member and the second upward-extending member.

20. The automated railroad tie unloading system of claim 13, further comprising a controller configured to coordinate actuation of the gate from the closed configuration to the open configuration with actuation of the lift structure from the lowered configuration to the raised configuration.

* * * * *